US008593285B2

(12) United States Patent
Fukai

(10) Patent No.: US 8,593,285 B2
(45) Date of Patent: Nov. 26, 2013

(54) SAFETY-DETERMINATION INFORMATION GENERATING APPARATUS AND SAFETY CONFIRMATION SYSTEM

(75) Inventor: Midori Fukai, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 975 days.

(21) Appl. No.: 12/656,364

(22) Filed: Jan. 27, 2010

(65) Prior Publication Data

US 2010/0134300 A1 Jun. 3, 2010

Related U.S. Application Data

(63) Continuation of application No. PCT/JP2007/064949, filed on Jul. 31, 2007.

(51) Int. Cl.
*G08B 23/00* (2006.01)

(52) U.S. Cl.
USPC ..... 340/573.1

(58) Field of Classification Search
USPC ..... 340/573.1, 506, 528, 539.1, 686.1, 340/13.24; 702/188, 187
See application file for complete search history.

(56) References Cited

U.S. PATENT DOCUMENTS

| | | | | |
|---|---|---|---|---|
| 5,410,471 | A * | 4/1995 | Alyfuku et al. | 600/300 |
| 6,002,994 | A * | 12/1999 | Lane et al. | 702/188 |
| 7,937,461 | B2 * | 5/2011 | Kutzik et al. | 709/224 |
| 8,321,562 | B2 * | 11/2012 | Kutzik et al. | 709/224 |
| 2005/0093709 | A1 * | 5/2005 | Franco et al. | 340/686.1 |

FOREIGN PATENT DOCUMENTS

| | | |
|---|---|---|
| JP | 07-102610 | 4/1995 |
| JP | 07-148122 | 6/1995 |
| JP | 07-317398 | 12/1995 |
| JP | 08-028109 | 1/1996 |
| JP | 2001-357477 | 12/2001 |
| JP | 2002-024966 | 1/2002 |
| JP | 2002-183843 | 6/2002 |
| JP | 2002-216274 | 8/2002 |
| JP | 2002-320602 | 11/2002 |
| JP | 2003-185315 | 7/2003 |
| JP | 2004-326623 | 11/2004 |
| JP | 2005-048370 | 2/2005 |
| JP | 2005-182411 | 7/2005 |
| JP | 2006-236357 | 9/2006 |
| JP | 2006-313446 | 11/2006 |
| JP | 2007-115053 | 5/2007 |

OTHER PUBLICATIONS

International Search Report for PCT/JP2007/064949, mailed Oct. 30, 2007.

* cited by examiner

*Primary Examiner* — Phung Nguyen
(74) *Attorney, Agent, or Firm* — Staas & Halsey LLP

(57) ABSTRACT

A safety-determination information generating apparatus detects that a toilet equipment used for excretion, which is a regular behavior in the daily life of a monitoring subject, is used. Once the flushing operation unit is touched by the monitoring subject who flushes the toilet after relieving himself/herself, the safety-determination information generating apparatus detects, using the contact sensor, the touching as the use of the equipment, and sends as the safety-determination information the equipment-use information representing that the toilet is used to a remote monitoring apparatus. The remote monitoring apparatus receives the safety-determination information sent by the safety-determination information generating apparatus and displays on the display that the monitoring subject has used the equipment on the basis of the safety-determination information.

5 Claims, 8 Drawing Sheets

FIG.4

2007/05/10/07:10 TOILET USED
2007/05/10/12:12 TOILET USED
2007/05/10/12:36 LEAVING ENTRANCE
2007/05/10/18:00 ENTERING ENTRANCE

FIG.5

| TIME INFORMATION | DETECTION IDENTIFICATION INFORMATION |
|---|---|
| 2007/05/10/07:10 | TOILET |
| 2007/05/10/12:12 | TOILET |
| 2007/05/10/12:36 | INNER DOOR KNOB |
| 2007/05/10/18:00 | OUTER DOOR KNOB |
| ⋮ | ⋮ |

FIG.10

WARNING!!

TOILET HAS NOT BEEN USED IN 24 HOURS FROM 8:30. AN ABNORMALITY MIGHT HAVE HAPPENED CONCERNING MR. TANAKA.

FIG.11

| TIME INFORMATION | DETECTION IDENTIFICATION INFORMATION | IDENTIFICATION RESULT INFORMATION |
|---|---|---|
| 2007/05/10/07:10 | TOILET | MONITORING SUBJECT |
| 2007/05/10/08:10 | TOILET | UNREGISTERED PERSON |
| 2007/05/10/12:36 | INNER DOOR KNOB | UNREGISTERED PERSON |
| 2007/05/10/15:12 | TOILET | MONITORING SUBJECT |
| 2007/05/11/08:30 | TOILET | MONITORING SUBJECT |
| ⋮ | ⋮ | ⋮ |

SAFETY-DETERMINATION INFORMATION GENERATING APPARATUS AND SAFETY CONFIRMATION SYSTEM

CROSS-REFERENCE TO RELATED APPLICATION(S)

This application is a continuation of International Application No. PCT/JP2007/064949, filed on Jul. 31, 2007, the entire contents of which are incorporated herein by reference.

FIELD

The embodiments discussed herein are directed to a safety-determination information generating apparatus that generates safety-determination information, which is used to determine whether a monitoring subject is safe, and sends the safety-determination information to a monitoring apparatus, and to a safety confirmation system that includes the safety-determination information generating apparatus and a remote monitoring apparatus.

BACKGROUND

In recent years, the number of people living alone has been increasing, and people tend to have less relationships with their neighbors. A person who lives alone and does not have relationship with his/her neighbors cannot notify people around him/her if an abnormality (for example, an accident or illness that may lead to death) happens concerning the person. To prevent such an event, various safety confirmation systems have been devised. Such a safety confirmation system is useful for, for example, relatives of a person living alone to confirm whether the person living alone is safe. It is also useful for an owner of a condominium to know early of an abnormality to the person living alone in the condominium and prevent the room and condominium from being spoiled due to decomposition of a body.

The above-mentioned systems include a system using an electronic kettle. Specifically, when a person living alone uses an electronic kettle, the kettle sends information notifying that the kettle is used to a surveillant terminal. The surveillant terminal displays the sent information on a display, and the surveillant determines whether the person living alone is safe because of the use of the kettle.

Methods in which a sensor is arranged in a living space are also used. Specifically, each time a sensor arranged in a living space detects that an object moves in the detection area of the sensor, it sends the detection information to a surveillant terminal. The surveillant terminal displays the sent detection information on a display, and the surveillant determines whether the person living alone is safe on the basis of the detection information. Japanese Laid-open Patent Publication No. 2002-24966 discloses a technology that enables the above method using a hidden sensor.

Japanese Laid-open Patent Publication No. 07-148122 discloses an emergency notifying system using a pedometer. Specifically, an old person living alone carries a pedometer, and the pedometer periodically sends information on the number of steps the old person makes to a nursing care center. In the nursing care center, a central unit determines the health condition of the old person on the basis of the level of the sent step-number information (for example, if the number of steps in a day is 200 or less, it is determined that the old person has become ill). When it is determined that an abnormality has happened, the manager confirms whether the old person is safe by, for example, making a call to the old person.

Japanese Laid-open Patent Publication No. 2005-182411 discloses, as a method of maintaining the safety of people living alone, a method in which a sensor to detect a fingerprint is arranged on a button on an entrance intercom. When a resident presses the button, the voice of another person is output from the intercom's speaker so that people think that there is somebody living with the resident.

However, the above-described technology only allows the surveillant to determine whether an abnormality has happened concerning the monitoring subject and has a problem in that reliable information cannot be provided.

Specifically, for the technology in which the use of the electric kettle is displayed on the display of the surveillant terminal, the monitoring subject uses the electric kettle arbitrarily, so the use may be terminated in the summer time or, even if the kettle is usually used, the kettle may still sometimes not be used. As described above, even through the monitoring subject is normal, the surveillant may make an erroneous determination because information representing the use of the kettle is received at longer intervals. Therefore, the surveillant only determines whether an abnormality has happened concerning the monitoring subject, and reliable information cannot be provided.

In the technology in which information that is sensed by the sensor, which is arranged in the living space, is displayed on the display of the surveillant terminal (the technology disclosed in Japanese Laid-open Patent Publication No. 2002-24966), even if, for example, the monitoring subject has already died, the sensor may keep sensing a small animal moving or a curtain moving by a window. Because, as in the above case, detection information may continue to be sent and the surveillant may make an erroneous determination even though an abnormality has happened concerning the monitoring subject, the surveillant only determines whether an abnormality has happened concerning the monitoring subject, and reliable information cannot be provided. Furthermore, in achieving such a system, there is a problem in that, in many cases, it is necessary to make a contract with a security company and modify the residence, i.e., the system is not applicable to the current living space.

In the technology disclosed in Japanese Laid-open Patent Publication No. 07-148122, it is necessary for a monitoring subject to carry a pedometer, but he/she may forget to carry the pedometer. As described above, even though the monitoring subject is normal, step-number information may not be sent and the surveillant may make an erroneous determination. Thus, the surveillant only determines whether an abnormality has happened concerning the monitoring subject, and reliable information cannot be provided.

SUMMARY

According to an aspect of an embodiment of the invention, a safety-determination information generating apparatus includes an equipment-use detecting unit that detects that an equipment used in a regular behavior in a daily life of the monitoring subject is used; and a sending unit that sends equipment-use information representing the use of the equipment, which is detected by the equipment-use detecting unit, as safety-determination information to a remote monitoring apparatus, the safety-determination information being used to determine whether a monitoring subject is safe.

The object and advantages of the embodiment will be realized and attained by means of the elements and combinations particularly pointed out in the claims.

It is to be understood that both the foregoing general description and the following detailed description are exemplary and explanatory and are not restrictive of the embodiment, as claimed.

BRIEF DESCRIPTION OF DRAWINGS

FIG. 4 is a diagram illustrating an example of an image displayed on a display;

FIG. 5 is a table illustrating an example of information stored in a safety-determination information storage unit;

FIG. 10 is a diagram illustrating an example of an image displayed on a display;

FIG. 11 is a diagram illustrating an example of information stored in a safety-determination information storage unit.

DESCRIPTION OF EMBODIMENTS

Preferred embodiments of the present invention will be explained with reference to accompanying drawings.

An outline and features of the safety confirmation system according to the present invention, and configurations of and processes performed by a safety-determination information generating apparatus and a remote monitoring apparatus of the safety confirmation system are sequentially explained. After the effects of the first embodiment are explained, other embodiments are explained.

[a] First Embodiment

Outline and Features of Safety Confirmation System

Figure 1:
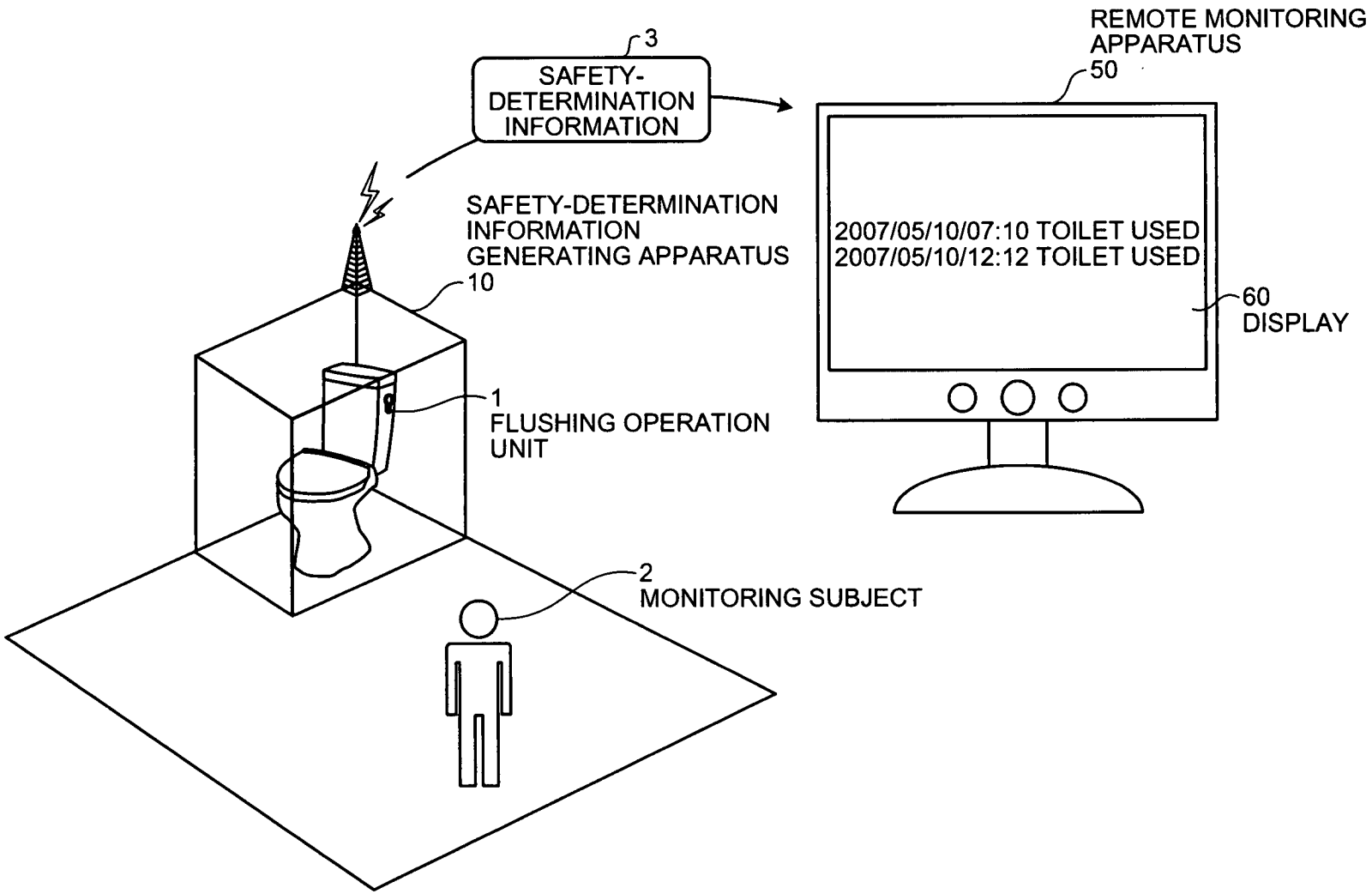
FIG. 1 is a diagram for explaining an outline and features of a safety confirmation system according to a first embodiment.

An outline and features of a safety confirmation system according to a first embodiment will be explained with reference to FIG. 1. FIG. 1 is a diagram for explaining an outline and features of the safety confirmation system according to the first embodiment. As illustrated in FIG. 1, the outline of the safety confirmation system is in that it includes a remote monitoring apparatus 50 that remotely monitors a monitoring subject 2, and a safety-determination information generating apparatus 10 that generates safety-determination information used to determine whether the monitoring subject 2 is safe and sends the safety-determination information to the remote monitoring apparatus 50. The features of the safety confirmation system is mainly in that it is detected that an equipment used in a regular behavior in a daily life of the monitoring subject 2 is used, equipment-use information representing the use of the equipment on the basis of the detection, and the equipment-use information is sent as safety-determination information 3 to the remote monitoring apparatus 50, so that it can be determined whether an abnormality has happened concerning the monitoring subject 2 and reliable information can be provided.

The main features can be explained in that, in the safety confirmation system, the safety-determination information generating apparatus 10 detects that the equipment that is used in the regular behavior in the daily life of the monitoring subject 2 is used. Explanation taking a specific example is in that, as illustrated in FIG. 1, the safety-determination information generating apparatus 10 detects that the monitoring subject 2 uses the toilet, with a contact sensor of a flushing operation unit 1 of the toilet.

The safety-determination information generating apparatus 10 sends as the safety-determination information 3 equipment-use information representing the use of the equipment to the remote monitoring apparatus 50. Explanation taking a specific explanation is in that, as illustrated in FIG. 1, when the monitoring subject 2 touches the flushing operation unit 1, the safety-determination information generating apparatus 10 detects that the toilet is used, with the contact sensor, and sends the equipment-use information as the safety-determination information 3 to the remote monitoring apparatus 50.

The remote monitoring apparatus 50 receives the safety-determination information 3, which is sent by the safety-determination information generating apparatus 10, and displays that the monitoring subject 2 uses the equipment on the basis of the safety-determination information 3. Explanation taking a specific example is in that, as illustrated in FIG. 1, the remote monitoring apparatus 50 displays characters such as "2007 May 10/07:10 TOILET USED" on a display 60 on the basis of the received safety-determination information 3.

In the safety confirmation system according to the first embodiment, as illustrated concerning its main features, it is detected that the equipment (for example, toilet), which is used in a regular behavior in the daily life of the monitoring subject, is used, the equipment-use information representing the use of the equipment is generated on the basis of the detection, and the equipment-use information is sent as the safety-determination information to the remote monitoring apparatus, so that the surveillant can determine whether an abnormality has happened concerning the monitoring subject and reliable information can be provided. In other words, the behavior supposed to be taken by the monitoring subject as long as he/she is alive is monitored by receiving the safety-determination information, and therefore it can be determined, if no safety-determination information is received, that an abnormality has happened concerning the monitoring subject. In this manner, the surveillant can determine whether an abnormality has happened concerning the monitoring subject, and reliable information can be provided.

Configuration of Safety-Determination Information Generating Apparatus

Figure 2:
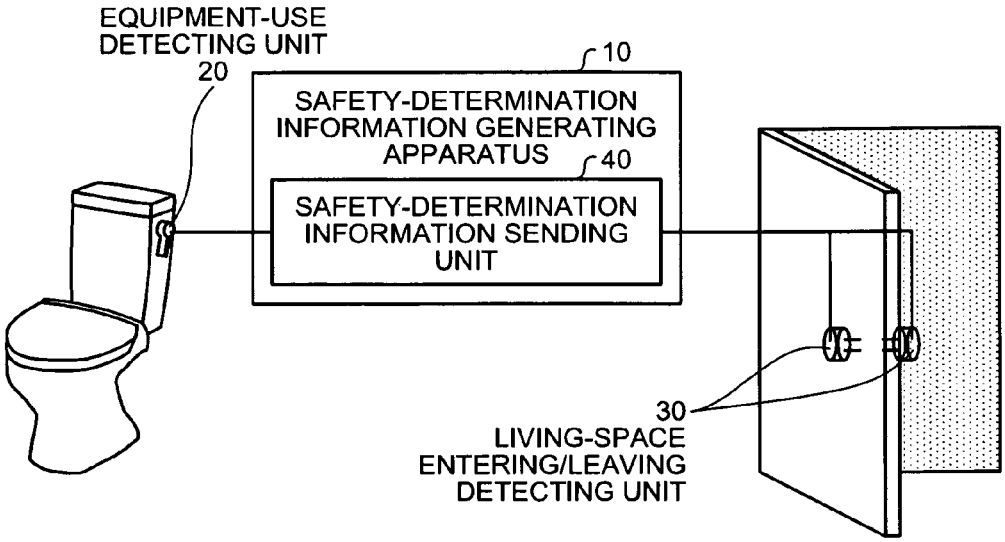
FIG. 2 is a block diagram illustrating a configuration of a safety-determination information generating apparatus.

A configuration of the safety-determination information generating apparatus 10 of the safety-confirmation system according to the first embodiment is explained below with reference to FIG. 2. FIG. 2 is a block diagram illustrating the configuration of the safety-determination information generating apparatus 10. As illustrated in FIG. 2, the safety-determination information generating apparatus 10 includes an equipment-use detecting unit 20, a living-space entering/leaving detecting unit 30, and a safety-determination information sending unit 40.

The equipment-use detecting unit 20 detects that the equipment used in the regular behavior in the daily life of the monitoring subject is used. Specifically, upon detecting the use of the toilet, which is used for excretion of the monitoring subject, the equipment-use detecting unit 20 sends a signal representing that the toilet is used to the safety-determination information sending unit 40 to be described below. For example, when the flushing operation unit is touched by the monitoring subject who flushes the toilet after relieving himself/herself, the equipment-use detecting unit 20 outputs a signal that is generated by the contact sensor of the flushing operation unit to the safety-determination information sending unit 40 to be described below. It is preferable that the equipment of which use is detected by the equipment-use detecting unit 20 be in the living space where the monitoring subject lives.

The living-space entering/leaving detecting unit 30 detects that the monitoring subject enters/leaves the living space. Explanation taking a specific example is in that, when the living-space entering/leaving detecting unit 30 detects that the monitoring subject detects that the monitoring subject enters/leaves the living space, with the contact sensor of a door knob at the entrance (the door knob in the living space or the door knob outside the living space), it sends a signal representing that the monitoring subject leaves/enters the living space to the safety-determination information sending unit 40.

The safety-determination information sending unit 40 sends to the remote monitoring apparatus 50 the equipment-use information representing the use of the equipment or the living-space entering/leaving information representing entering/leaving the living space as the safety-determination information that is used to determine whether the monitoring subject is safe. Specifically, upon receiving the signal representing that the toilet is used from the equipment-use detecting unit 20, or receiving the signal representing that the monitoring subject leaves or enters the living space from the living-space entering/leaving detecting unit 30, the safety-determination information sending unit 40 generates the equipment-use information, or the living-space entering/leaving information, consisting of time information representing the time at which the detection is performed and detection identification information identifying which detecting unit performs detection, and sends the equipment-use information or the living-space entering/leaving information as the safety-determination information to the remote monitoring apparatus 50 to be described below. For example, upon receiving the signal from the equipment-use detecting unit 20, the safety-determination information sending unit 40 generates the equipment-use information consisting of time information "2007 May 10/07:10" and detection identification information "TOILET" and sends the equipment-use information as the safety-determination information to the remote monitoring apparatus 50. The detection identification information of the living-space entering/leaving information is divided into "INNER DOOR KNOB" and "OUTER DOOR KNOB".

Configuration of Remote Monitoring Apparatus

Figure 3:
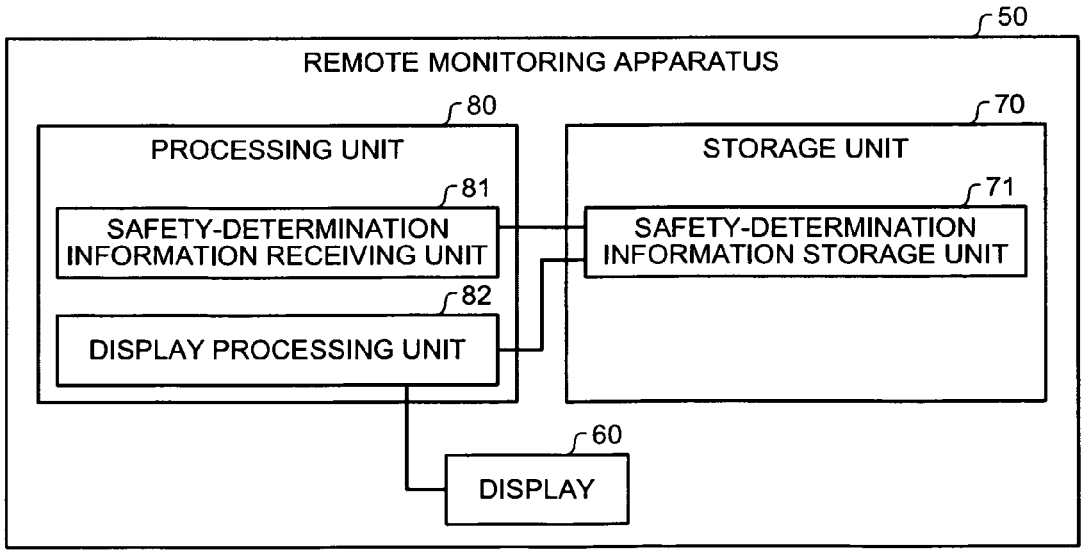
FIG. 3 is a block diagram illustrating a configuration of a remote monitoring apparatus.

A configuration of the remote monitoring apparatus 50 of the safety confirmation system according to the first embodiment is explained below with reference to FIG. 3. FIG. 3 is a block diagram illustrating the configuration of the remote monitoring apparatus 50. As illustrated in FIG. 3, the remote monitoring apparatus 50 includes the display 60, a storage unit 70, and a processing unit 80.

The display 60 displays that the monitoring subject uses the equipment or enters/leaves the living space. Specifically, the display 60 receives display information that is output by a display processing unit 82 to be described below, and displays an image. For example, the display 60 displays the characters "2007 May 10/07:10 TOILET USED" as illustrated in FIG. 4. FIG. 4 is a diagram illustrating an example of the image displayed on the display 60.

The storage unit 70 stores therein data to be used for various processes performed by the processing unit 80. Particularly, the storage unit 70 includes a safety-determination information storage unit 71 as one closely related to the present invention.

The safety-determination information storage unit 71 stores the equipment-use information, or the living-space entering/leaving information, that is sent as the safety-determination information by the safety-determination information generating apparatus 10. Specifically, as illustrated in FIG. 5, the safety-determination information storage unit 71 receives the equipment-use information or the living-space entering/leaving information as the safety-determination information from a safety-determination information receiving unit 81, and sores the time information and the detection identification information, which are components of the equipment-use information or the living-space entering/leaving information, in association with each other. For example, as illustrated in FIG. 5, the safety-determination information storage unit 71 stores therein the time information "2007 May 10/07:10" and the detection identification information "TOILET" in association with each other. FIG. 5 is a table illustrating an example of information stored in the safety-determination information storage unit 71.

The processing unit 80 is a processor that includes an internal memory for storing programs that defines various process procedures and control data, and that performs various processes using the programs and control data. Particularly, the processing unit 80 includes the safety-determination information receiving unit 81 and the display processing unit 82 as one closely related to the present invention.

The safety-determination information receiving unit 81 receives the equipment-use information or the living-space entering/leaving information as the safety-determination information. Specifically, the safety-determination information receiving unit 81 receives the equipment-use information or the living-space entering/leaving information, which is sent as the safety-determination information by the safety-determination information sending unit 40 of the safety-determination information generating apparatus 10, and stores the safety-determination information in the safety-determination information in the safety-determination information storage unit 71. For example, on the basis of the equipment-use information received as the safety-confirmation information, the safety-determination information receiving unit 81 stores the time information "2007 May 10/07:10" and the detection identification information "TOILET" in association with each other in the safety-determination information storage unit 71.

The display processing unit 82 displays the use of the toilet or entering/leaving the living space on the display 60. Specifically, after the time information and the detection identification information are stored in association with each other in the safety-determination information storage unit 71, the display processing unit 82 displays on the display 60 that the monitoring subject uses the toilet or enters/leaves the living space on the basis of the information. For example, the display processing unit 82 displays on the display 60 the characters "2007 May 10/07:10" on the basis of the time information "2007 May 10/07:10", and displays on the display 60 the characters "TOILET USED" on the basis of the detection identification information "TOILET" (see FIG. 4).

Process Performed by Safety-Determination Information Generating Apparatus

Figure 6:
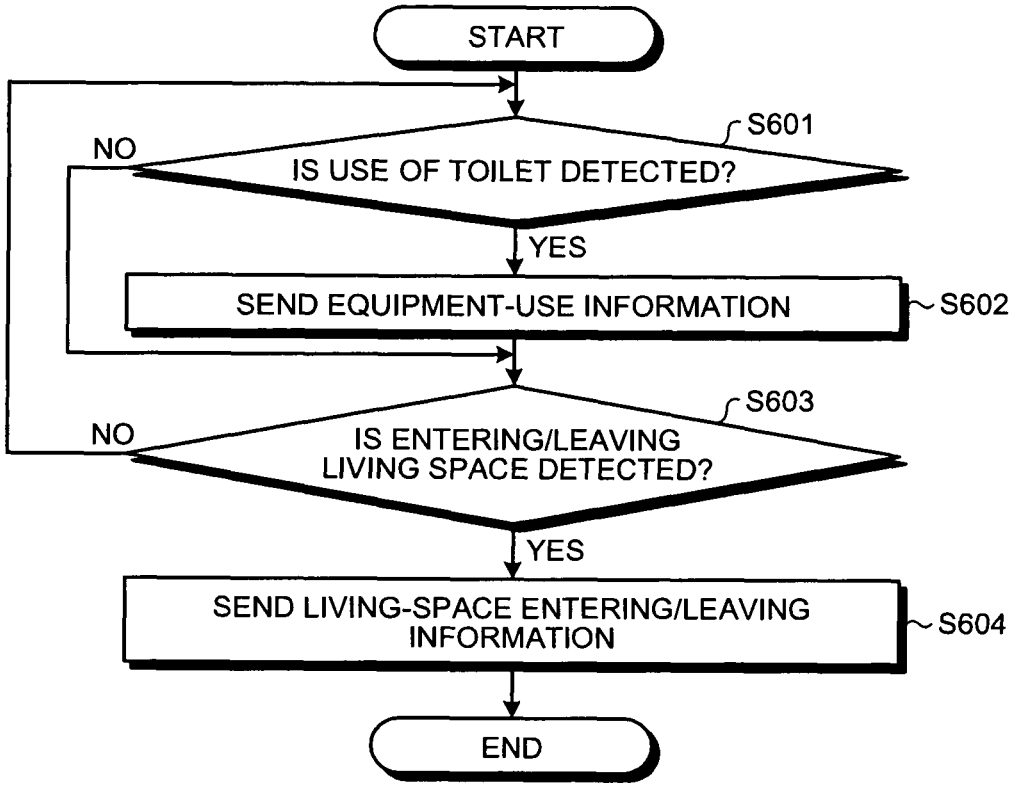
FIG. 6 is a flowchart illustrating a flow of a safety-determination information sending process performed by the safety-determination information generating apparatus.

The process performed by the safety-determination information generating apparatus 10 is explained below with reference to FIG. 6. FIG. 6 is a flowchart representing the flow of a safety-determination information sending process performed by the safety-determination information generating apparatus 10.

As illustrated in FIG. 6, in the safety-determination information generating apparatus 10, when the equipment-use detecting unit 20 detects that the monitoring subject uses the toilet (YES at step S601), the safety-determination information sending unit 40 generates the equipment-use information and sends the equipment-use information as the safety-determination information to the remote monitoring apparatus 50 (step S602). On the other hand, in the safety-determination information generating apparatus 10, when the living-space entering/leaving detecting unit 30 detects that the monitoring subject enters/leaves the living space (YES at step S603), the safety-determination information sending unit 40 generates the living-space entering/leaving information and sends the living-space entering/leaving information as the safety-determination information to the remote monitoring apparatus 50 (step S604). While the safety-determination information generating apparatus 10 operates, the series of processes from step S601 to step S604 is repeatedly performed.

Process Performed by Remote Monitoring Apparatus

Figure 7:
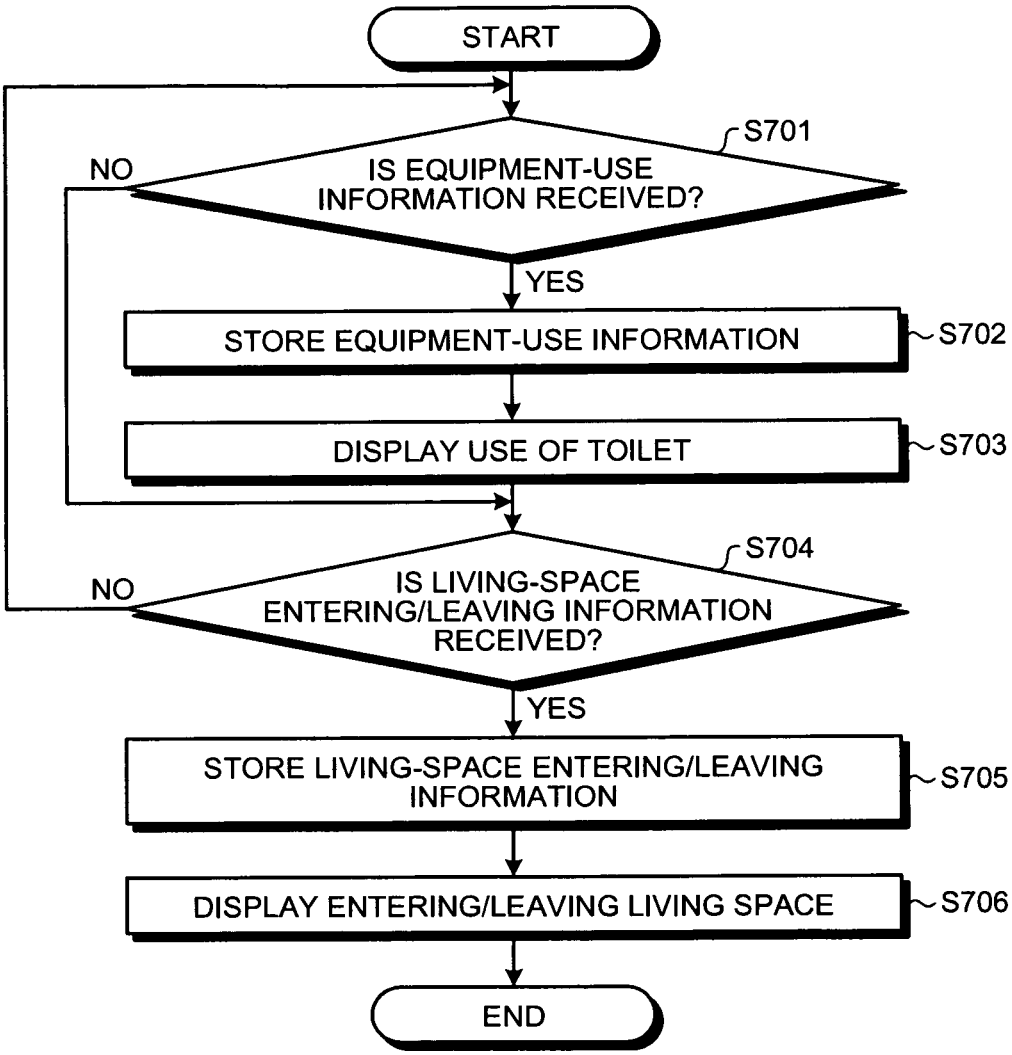
FIG. 7 is a flowchart illustrating a flow of a safety-determination information receiving process performed by the remote monitoring apparatus.

A process performed by the remote monitoring apparatus 50 is explained below with reference to FIG. 7. FIG. 7 is a flowchart illustrating the flow of a safety-determination information receiving process performed by the remote monitoring apparatus 50.

In the remote monitoring apparatus 50, as illustrated in FIG. 7, when the safety-determination information receiving unit 81 receives the equipment-use information, which is sent as the safety-determination information by the safety-determination information generating apparatus 10 (YES at step S701), the received equipment-use information is stored in the safety-determination information storage unit 71 (step S702), and the display processing unit 82 displays on the display 60 the use of the toilet on the basis of the stored equipment-use information (step S703). In the remote monitoring apparatus 50, on the other hand, when the living-space entering/leaving information is received as the safety-determination information (YES at step S704), the received living-space entering/leaving information is stored in the safety-determination information storage unit 71 (step S705), and the display processing unit 82 displays the entering/leaving the living space on the basis of the stored living-space entering/leaving information (step S706). While the remote monitoring apparatus 50 operates, the series of processes from step S701 to step S706 is repeated.

Advantage of First Embodiment

As described above, in the safety confirmation system according to the first embodiment, the safety-determination information generating apparatus detects the use of the toilet, which is used for excretion of the monitoring subject, and sends the equipment-use information representing the use of the toilet as the safety-determination information to the remote monitoring apparatus. The remote monitoring apparatus receives the equipment-use information, which is sent by the safety-determination information generating apparatus, and displays on the display that the monitoring subject uses the toilet on the basis of the received equipment-use information. Therefore, the surveillant can determine whether an abnormality has happened concerning the monitoring subject and reliable information can be provided. In other words, the behavior supposed to be taken by the monitoring subject as long as he/she is alive is monitored by receiving the safety-determination information, and, if no safety-determination information is received, it can be determined that an abnormality has happened concerning the monitoring subject. In this manner, the surveillant can determine whether an abnormality has happened concerning the monitoring subject, and reliable information can be provided.

In addition, the safety-determination information generating apparatus according to the first embodiment detects that the monitoring subject enters/leaves the living space, and sends as the safety-determination information the equipment-use information representing the use of the toilet and the living-space entering/leaving information representing the entering/leaving the living space to the remote monitoring apparatus. Therefore, it can be prevented to make an erroneous determination because the monitoring subject goes out. In other words, the state where no equipment-use information is received can be divided into a state where it is caused because an abnormality has happened concerning the monitoring subject in the living space and a state where it is caused because the monitoring subject goes out. This prevents an erroneous determination caused when the monitoring subject goes out.

[b] Second embodiment

In a second embodiment, the case is explained where it is detected that a monitoring subject uses a toilet or enters/leaves a living space, where it is identified whether the detection is performed because the monitoring subject uses the toilet or the detection is performed because a person other than the monitoring subject uses the toilet, and where, for detection of entering/leaving the living space, it is identified whether the detection is performed because the monitoring subject enters/leaves the living space or the detection is performed because a person other than the monitoring subject enters/leaves the living space.

Configuration of Safety-Determination Information Generating Apparatus

Figure 8:
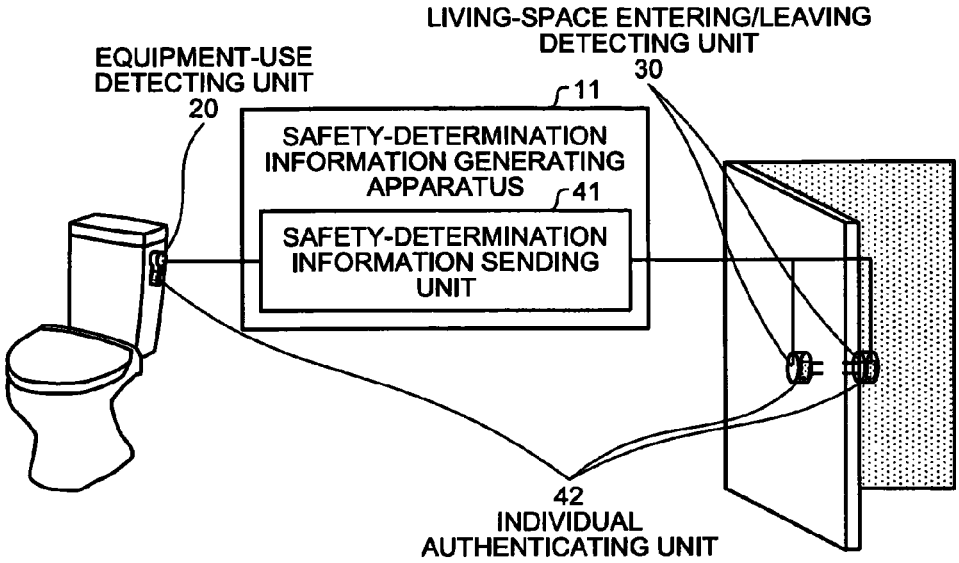
FIG. 8 is a block diagram illustrating a configuration of a safety-determination information generating apparatus according to a second embodiment.

A configuration of a safety-determination information generating apparatus 11 of a safety-confirmation system according to the second embodiment is explained below with reference to FIG. 8. FIG. 8 is a block diagram illustrating the configuration of the safety-determination information generating apparatus 11 according to the second embodiment. As illustrated in FIG. 8, the safety-determination information generating apparatus 11 includes the equipment-use detecting unit 20, the living-space entering/leaving detecting unit 30, a safety-determination information sending unit 41, and an individual authenticating unit 42. The operations of the equipment-use detecting unit 20 and the living-space entering/leaving detecting unit 30 are the same as those in the first embodiment, so explanation thereof is omitted.

The individual authenticating unit 42 identifies, about the detection performed by the equipment-use detecting unit 20, whether the detection is performed because the monitoring subject uses the equipment or the detection is performed because a person other than the monitoring subject uses the equipment. The individual authenticating unit 42 also identifies, about the detection performed by the living-space entering/leaving detecting unit 30, whether the detection is performed because the monitoring subject enters/leaves the living space or the detection is performed because a person other than the monitoring subject enters/leaves the living space. Specifically, when the equipment-use detecting unit 20 detects the use of the toilet, or the living-space entering/leaving detecting unit 30 detects entering/leaving the living space, the individual authenticating unit 42 determines, about the detection, whether the detection is performed because the monitoring subject uses the toilet or the detection is performed because the monitoring subject enters/leaves the living space. The individual authenticating unit 42 generates identifying information representing the monitoring subject or a person other than the monitoring subject, and outputs the identifying information to the safety-determination information sending unit 41. For example, when the flushing operation unit is touched by the monitoring subject who flushes the toilet after relieving himself/herself, the individual authenticating unit 42 identifies whether the person is the monitoring subject, with a fingerprint authentication sensor of the flushing operation unit, and outputs identification result information "MONITORING SUBJECT" representing the result of identification to the safety-determination information sending unit 41.

The safety-determination information sending unit 41 sends the equipment-use information and the living-space entering/leaving information as the safety-determination information to the remote monitoring apparatus 50. Specifically, upon receiving a signal representing that the toilet is used from the equipment-use detecting unit 20 and receiving the identification result information representing whether the person is the monitoring subject from the individual authenticating unit 42, or upon receiving a signal representing that the monitoring subject leaves/enters the living space from the living-space entering/leaving detecting unit 30 and receiving the identification result information representing whether the person is the monitoring subject from the individual authenticating unit 42, the safety-determination information sending unit 41 generates the equipment-use information, or the living-space entering/leaving information, which consists of time information representing the time at which detection is performed and detection identification information identifying which detecting unit performs detection, and the identification result information, on the basis of the signal and the identification result information, and sends the equipment-use information or the living-space entering/leaving information as the safety-determination information to a remote monitoring apparatus 51. For example, upon receiving the signal from the equipment-use detecting unit 20 and the identification result information "MONITORING SUBJECT" representing that the person is the monitoring subject from the individual authenticating unit 42, the safety-determination information sending unit 41 generates the equipment-use information, which consists of the time information "2007 May 10/07:10", the detection identification information "TOILET", and the identification result information "MONITORING SUBJECT", and sends the equipment-use information as the safety-determination information to the remote monitoring apparatus 51.

Configuration of Remote Monitoring Apparatus

Figure 9:
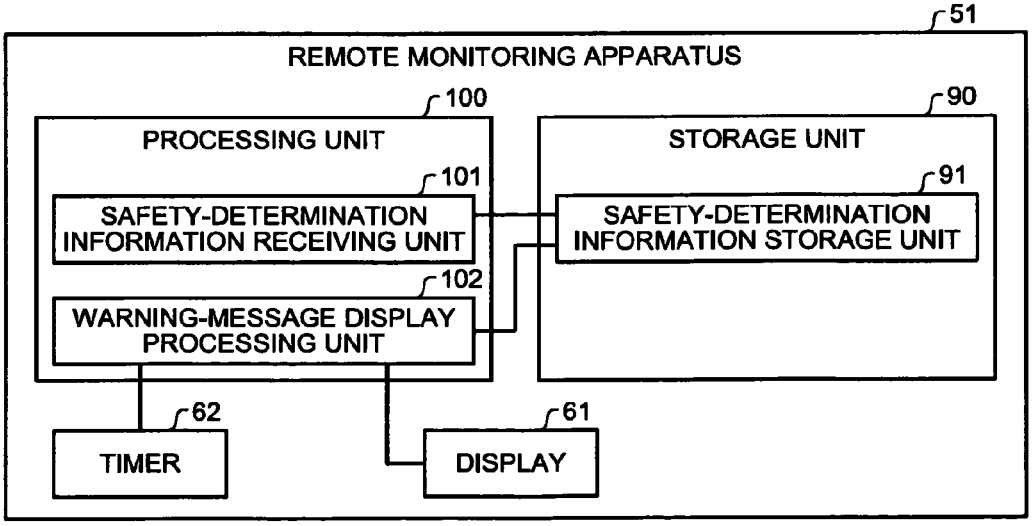
FIG. 9 is a block diagram illustrating a configuration of a remote monitoring apparatus according to the second embodiment.

A configuration of the remote monitoring apparatus 51 of the safety confirmation system according to the second embodiment is explained below with reference to FIG. 9. FIG. 9 is a block diagram illustrating the configuration of the remote monitoring apparatus 51 according to the second embodiment. As illustrated in FIG. 9, the remote monitoring apparatus 51 includes a display 61, a timer 62, a storage unit 90, and a processing unit 100. The display 61 may be referred to as a notifying unit.

The display 61 displays a warning message. Specifically, the display 61 receives display information that is output by a warning-message display processing unit 102 of the processing unit 100, which is described below, and displays an image. For example, the display 61 displays the sentence "WARNING!! Toilet has not been used in 24 hours from 8:30. An abnormality might have happened concerning Mr. Tanaka." illustrated in FIG. 10. FIG. 10 is a diagram illustrating an example of the image displayed on the display 61.

The timer 62 measures the time elapsing, and starts the operation after a predetermined time elapses. Specifically, upon receiving a signal of an instruction for starting to measure the elapse of time from the warning-message display processing unit 102 of the processing unit 100 to be described below, the timer 62 starts the elapse of time. After the predetermined time (for example 12 hours) elapses, the timer 62 outputs a signal representing that the predetermined time elapses to the warning-message display processing unit 102. Upon receiving the signal of an instruction for finishing measuring the elapse of time from the warning-message display processing unit 102, the timer 62 finishes measuring the elapse of time. To start measuring the elapse of time, the timer 62 resets the previous measurement.

The storage unit 90 stores therein data that is used for various processes performed by the processing unit 100. Particularly, the storage unit 90 includes a safety-determination information storage unit 91 as one closely related to the present invention.

The safety-determination information storage unit 91 stores therein as the safety-determination information the equipment-use information or the living-space entering/leaving information, which is sent by the safety-determination information generating apparatus 11. Specifically, as illustrated in FIG. 11, the safety-determination information storage unit 91 receives as the safety-determination information the equipment-use information or the living-space entering/leaving information from a safety-determination information receiving unit 101 to be described below, and stores therein the time information, the detection identification information, and the identification result information, which are components of the equipment-use information or the living-space entering/leaving information, in association with one another. For example, as illustrated in FIG. 11, the safety-determination information storage unit 91 stores therein the time information "2007 May 10/07:10", the detection identification information "TOILET", and the identification result information "MONITORING SUBJECT" in association with one another. FIG. 11 is a diagram illustrating an example of the information stored in the safety-determination information storage unit 91.

The processing unit 100 is a processor that includes an internal memory for storing programs that define various process procedures and control data, and performs various processes using the programs and control data. Particularly, the processing unit 100 includes the safety-determination information receiving unit 101 and the warning-message display processing unit 102 as one closely related to the present invention. The warning-message display processing unit 102 may be referred to as an abnormality determining unit.

The safety-determination information receiving unit 101 receives the equipment-use information or the living-space entering/leaving information as the safety-determination information. Specifically, the safety-determination information receiving unit 101 receives the equipment-use information or the living-space entering/leaving information, which is sent as the safety-determination information by the safety-determination information sending unit 41 of the safety-determination information generating apparatus 11, and stores the safety-determination information in the safety-determination information storage unit 91. For example, on the basis of the equipment-use information received as the safety-determination information, the safety-determination information receiving unit 101 stores the time information "2007 May 10/07:10", the detection identification information "TOI- LET", and the identification result information "MONITORING SUBJECT" in association with one another in the safety-determination information storage unit 91.

The warning-message display processing unit 102 determines whether the monitoring subject is safe on the basis of the use of the equipment based on the equipment-use information, which is received as the safety-determination information from the safety-determination information generating apparatus 11. Specifically, when the detection identification information "TOILET" and the identification result information "MONITORING SUBJECT" are stored in association with each another in the safety-determination information storage unit 91, the warning-message display processing unit 102 outputs a signal of an instruction for starting to measure the elapse of time to the timer 62. Upon receiving a signal representing that the predetermined time has elapsed from the timer 62, the warning-message display processing unit 102 displays a warning message on the display 61 (see FIG. 10). When the detection identification information "TOILET" and the identification result information "MONITORING SUBJECT" are stored in association with each other in the safety-determination information storage unit 91 until the warning-message display processing unit 102 receives the signal representing that the predetermined time has elapsed from the timer 62 after outputting a signal of an instruction for starting to measure the elapse of time to the timer 62, the warning-message display processing unit 102 outputs again a signal of an instruction for starting to measure the elapse of time to the timer 62. When the detection identification information "INNER DOOR KNOB" and the identification result information "MONITORING SUBJECT" are stored in association with each other in the safety-determination information storage unit 91 until the warning-message display processing unit 102 receives the signal representing that the predetermined time has elapsed from the timer 62 after outputting a signal of an instruction for starting to measure the elapse of time to the timer 62, the warning-message display processing unit 102 outputs a signal of an instruction for finishing measuring the elapse of time to the timer 62.

Process Performed by Remote Monitoring Apparatus

Figure 12:
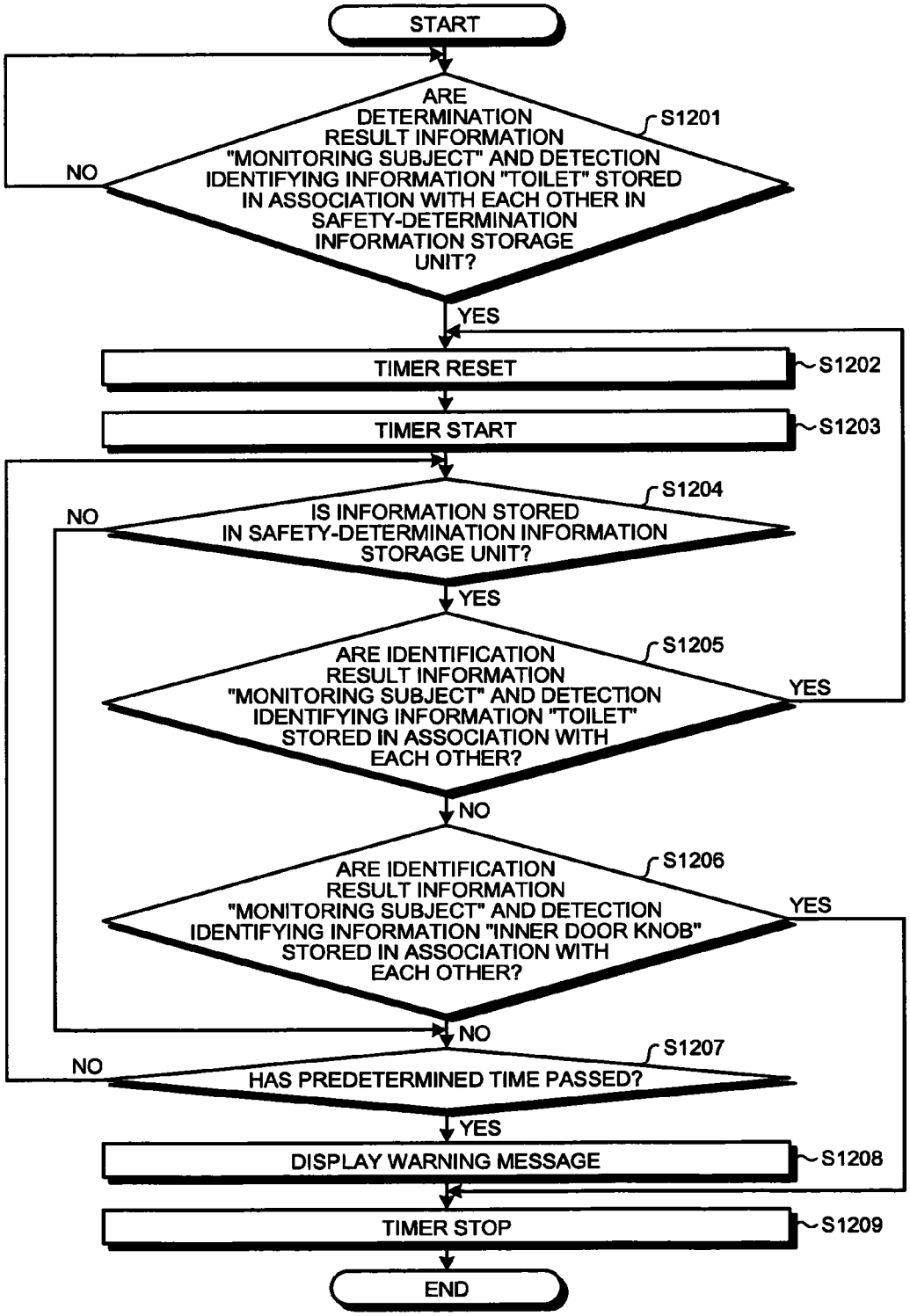
FIG. 12 is a flowchart illustrating a flow of a safety-determining process performed by the remote monitoring apparatus.

A process performed by the remote monitoring apparatus 51 is explained below with reference to FIG. 12. FIG. 12 is a flowchart illustrating the flow of a safety-determining process performed by the remote monitoring apparatus 51.

In the remote monitoring apparatus 51, as illustrated in FIG. 12, after the identification result information "MONITORING SUBJECT" and the detection identification information "TOILET" are stored in association with each other in the safety-determination information storage unit 91 (YES at step S1201), the warning-message display processing unit 102 outputs the signal of an instruction for starting to measure the elapse of time to the timer 62 to reset the timer 62 (step S1202), and starts the timer 62 (step S1203). The warning-message display processing unit 102 monitors whether new information is stored in the safety-determination information storage unit 91 (step S1204). When no new information is stored (NO at step S1204) and the predetermined time has elapsed (YES at step S1207), the warning message display processing unit 102 displays a warning message on the display 61 (step S1208) and outputs the signal of an instruction for finishing measuring the elapse of time to the timer 62 to stop the timer 62 (step S1209).

Back to step A1204, when new information is stored in the safety-determination information storage unit 91 (YES at step S1204) and the information is the identification result information "MONITORING SUBJECT" and the detection identification information "TOILET", which are associated with each other, (YES at step S1205), the warning message display processing unit 102 returns to step S1202 and outputs the signal of an instruction for starting to measure the elapse of time to the timer 62 to reset the timer 62 (step S1202) and starts the timer 62 (step S1203).

When new information is stored in the safety-determination information storage unit 91 (YES at step S1204) and the information is the identification result information "MONITORING SUBJECT" and the detection identification information "INNER DOOR KNOB" (NO at step S1205 to YES at step S1206), the warning-message display processing unit 102 outputs the signal of an instruction for finishing measuring the elapse of time to the timer 62 to stop the timer 62 (step S1209).

When new information is stored in the safety-determination information storage unit 91 (YES at step S1204), the information is not the identification result information "MONITORING SUBJECT" and the detection identification information "TOILET", or the identification result information "MONITORING SUBJECT" and the detection identification information "INNER DOOR KNOB", which are associated with each other (NO at step S1205 to NO at step S1206), and the predetermined time has elapsed (YES at step S1207), the warning-message display processing unit 102 displays the warning message on the display 61 (step S1208), and outputs the signal of an instruction for finishing measuring the elapse of time to the timer 62 to stop the timer 62 (step S1209). While the remote monitoring apparatus 51 operates, the series of processes from step S1201 to step S1209 is repeated. For the above-described flowchart, the case is explained where the information in which the identification result information "MONITORING SUBJECT" and the detection identification information "OUTER DOOR KNOB" are associated with each other is not used as the safety-determination information that is used to determine safety. However, the present invention is not limited to this, and, for example, it may be used as the safety-determination information by adding a process for displaying a warning message in the case where the information in which identification result information "MONITORING SUBJECT" and the detection identification information "TOILET" are associated with each other is not stored for the predetermined time after the information in which the identification result information "MONITORING SUBJECT" and the detection identification information "OUTER DOOR KNOB" are associated with each other is stored.

Advantage of Second Embodiment

As described above, in the safety confirmation system according to the second embodiment, it is identified, about the detection performed by the equipment-use detecting unit and the living-space entering/leaving detecting unit, whether the detection is performed because of the monitoring subject or the detection is performed because of a person other than the monitoring subject, and the equipment-use information, the living-space entering/leaving information, and identification result information are sent to the remote monitoring apparatus. This prevents an erroneous determination even when a third party other than the monitoring subject enters/leaves the living space and the monitoring subject goes out. In other words, the state where the equipment-use information is received is divided into the case where it is because the monitoring subject uses the equipment, where it is because a third party other than the monitoring subject uses the equipment although an abnormality has happened concerning the monitoring subject, or where it is because a third party other than the monitoring subject uses the equipment while the monitoring subject goes out. In addition, the state where no equipment-use information is received is divided into the state where it is because an abnormality has happened concerning the monitoring subject, and the state where it is because the monitoring subject goes out. This prevents an erroneous determination even when a third party other than the monitoring subject enters/leaves the living space and the monitoring subject goes out.

[c] Third Embodiment

The embodiments of the present invention are explained above. The present invention may be carried out in various different modes in addition to the above-described embodiments. Different embodiments divided into (1) to (6) are explained below.

(1) Information Sent to Remote Monitoring Apparatus

For the first embodiment, the case is explained where the equipment-use information or the living-space entering/leaving information is sent to the remote monitoring apparatus and the use of the toilet or the entering/leaving the living space is displayed on the display in the remote monitoring apparatus. However, the present invention is not limited to this. Only the equipment-use information may be sent. In this case, if the monitoring subject does not go out and no third party other than the monitoring subject enters/leaves the living space, the surveillant can determine whether an abnormality has happened concerning the monitoring subject and reliable information can be provided.

(2) Individual Authentication

For the second embodiment, the case is explained above where individual authentication is performed for a detection of the use of the equipment and entering/leaving the living space. However, the present invention is not limited to this. Individual authentication may be performed for only the detection of the use of the equipment. In this case, if a third party other than the monitoring subject enters/leaves the living space but the monitoring subject does not go out, the surveillant can determine whether an abnormality has happened concerning the monitoring subject, and reliable information can be provided.

(3) Regular Behavior in Daily Life

For the first embodiment, the regular behavior of the monitoring subject in the daily life is explained as excretion. However, the present invention is not limited to this. For example, sleeping of the monitoring subject may be set as the regular behavior in the daily life and the use of a bed may be detected with a pressure sensor provided to the bed.

(4) Individual Authentication

For the second embodiment, the case is explained where, with the fingerprint authentication sensor, it is determined whether the monitoring subject uses the toilet or enters/leaves the living space. However, the present invention is not limited to this. For example, a vein sensor may be used.

(5) Determination of Abnormality

For the second embodiment, the case is explained where a warning message is displayed on the condition that the monitoring subject has not gone out since he/she used the toilet for the last time and the predetermined time has elapsed. However, the present invention is not limited to this. For example, a threshold of the number of times the toilet is used in a day may be stored, and, on the condition that the number of times the toilet is used exceeds the threshold, a warning message (for example, the number of times of excretion is abnormal. An abnormality might have happened concerning Mr. Tanaka) may be displayed.

(6) System Configuration

Each component of each apparatus illustrated herein is a schematic functional element, and thus it is not required that each apparatus is physically configured as illustrated. In other words, specific modes of dispersion and integration of each apparatus are not limited to those illustrated in the drawings. Each apparatus may be configured in a way that it is entirely or partly dispersed and integrated functionally or physically on an arbitrary-unit basis depending on each type of load and the use of the apparatus, for example, the safety-determination information sending unit 40 may be dispersed into an equipment-use information sending unit and a living-space entering/leaving information sending unit. Furthermore, each processing function to be performed by each apparatus may be entirely or arbitrarily partly implemented by a CPU or a program that is analyzed and executed by the CPU, or may be implemented as wired logic hardware.

The process procedures, control procedures, specific names, and information containing various data and parameters, which are illustrated herein and the drawings, may be changed arbitrarily except the case where specified. For example, the detection determination information is not limited to "TOILET", and it suffices that, with the detection determination information, which detecting unit has made a determination can be determined uniquely.

According to the embodiment, an erroneous determination can be prevented even when a third party other than the monitoring subject enters/leaves.

According to the embodiment, the surveillant can notice that an abnormality has happened concerning the monitoring subject.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A remote monitoring apparatus that remotely monitors a monitoring subject, comprising:

a receiving unit that receives, from a unit that is equipped in a living space where the monitoring subject lives, first information in which a time when a use of an equipment existing in the living space and used in a regular behavior in a daily life of the monitoring subject is detected and an identification result indicating whether a person used the equipment at the time is the monitoring subject or an other person are associated with each other, second information in which a time when a person leaves the living space and an identification result indicating whether the person is the monitoring subject or an other person are associated with each other, and third information in which a time when a person enters the living space and an identification result indicating whether the person is the monitoring subject or an other person are associated with each other;

a safety determining unit that determines, when the second information and the third information received by the receiving unit indicate that the monitoring subject exists in the living space, whether the monitoring subject is safe based on the first information received by the receiving unit; and a notifying unit that notifies, when the safety determining unit determines that an abnormality has happened concerning the monitoring subject, that an abnormality has happened concerning the monitoring subject.

2. The remote monitoring apparatus according to claim 1, wherein the safety determining unit determines, when the second information and the third information indicate that the monitoring subject exists in the living space and when the first information indicates that the monitoring subject does not use the equipment at a time when a predetermined time has passed since the time when the monitoring subject used the equipment, an abnormality has happened concerning the monitoring subject.

3. The remote monitoring apparatus according to claim 1, wherein the safety determining unit determines, when the second information and the third information indicate that the monitoring subject entered and exists in the living space and when the first information indicates that the monitoring subject does not use the equipment at a time when a predetermined time has passed since the time when the monitoring subject entered the living space, an abnormality has happened concerning the monitoring subject.

4. The remote monitoring apparatus according to claim 1, wherein the receiving unit receives, as the first information, information in which a time when a use of a toilet used for excretion by the monitoring subject is detected and an identification result indicating whether a person used the toilet at the time is the monitoring subject or an other person are associated with each other.

5. The remote monitoring apparatus according to claim 1, further comprising a display processing unit that displays on a display unit, as safety-determination information, the first information, the second information or the third information that is received by the receiving unit.

* * * * *